US011772875B2

(12) United States Patent
White et al.

(10) Patent No.: US 11,772,875 B2
(45) Date of Patent: Oct. 3, 2023

(54) SYSTEM TO HOLD MULTIPLE BEVERAGE CONTAINERS

(71) Applicant: Lightbulb Innovation, LLC, Temple, TX (US)

(72) Inventors: Russell W. White, Austin, TX (US); Shawn A. Roberts, Temple, TX (US); Laura J. Roberts, Allen, TX (US)

(73) Assignee: Lightbulb Innovation, LLC, Temple, TX (US)

( * ) Notice: Subject to any disclaimer, the term of this patent is extended or adjusted under 35 U.S.C. 154(b) by 0 days.

(21) Appl. No.: 17/834,348

(22) Filed: Jun. 7, 2022

(65) Prior Publication Data

US 2022/0297921 A1 Sep. 22, 2022

Related U.S. Application Data

(63) Continuation-in-part of application No. 16/943,057, filed on Jul. 30, 2020, now Pat. No. 11,401,102, (Continued)

(51) Int. Cl.
*B65D 81/38* (2006.01)
*B65D 25/24* (2006.01)
(Continued)

(52) U.S. Cl.
CPC ..... *B65D 81/3897* (2013.01); *B65D 25/14* (2013.01); *B65D 25/24* (2013.01);
(Continued)

(58) Field of Classification Search
CPC ..... B65D 81/3897; B65D 81/3888; B65D 81/3876; B65D 81/261; B65D 88/22;
(Continued)

(56) References Cited

U.S. PATENT DOCUMENTS 5,131,732 A 7/1992 Lane
6,814,252 B2 11/2004 Murakami
(Continued)

FOREIGN PATENT DOCUMENTS

DE 12005035674 7/2006
DE 102005035676 7/2006
WO WO9924327 5/1999

OTHER PUBLICATIONS

English Language Translation of German Publication No. 102005035676, 16 pages total.
(Continued)

*Primary Examiner* — Robert J Hicks
(74) *Attorney, Agent, or Firm* — Trop, Pruner & Hu, P.C.

(57) ABSTRACT

A system for holding multiple beverage containers may include a cooler or carrier with toting handles, closing tabs, and base. The base may be formed from a molded plastic, rubber or synthetic rubber material. The base may also include feet that hold the base a sufficient height from the ground. The base may have a generally conic tapering drain floor that makes up its top surface. The tapering drain floor may make draining the carrier easier by directing water toward a drain hole located in the base. Extending up from the base may be a multi-layer soft-sided wall where different layers perform different desired functions. For example, an inside layer closest to the internal cavity may be a waterproof layer, a middle layer may be an insulating layer, and an external layer may be a decorative layer.

20 Claims, 10 Drawing Sheets

Related U.S. Application Data which is a continuation of application No. 16/115,871, filed on Aug. 29, 2018, now Pat. No. 10,730,685.

(60) Provisional application No. 62/560,295, filed on Sep. 19, 2017.

(51) Int. Cl.

| | |
|---|---|
| ***B65D 25/28*** | (2006.01) |
| ***B65D 25/14*** | (2006.01) |
| ***B65D 25/38*** | (2006.01) |
| ***F25D 3/08*** | (2006.01) |
| ***B65D 88/16*** | (2006.01) |
| *F25D 21/14* | (2006.01) |

(52) U.S. Cl.

CPC ..... *B65D 25/2864* (2013.01); *B65D 25/38* (2013.01); *B65D 88/16* (2013.01); *F25D 3/08* (2013.01); *F25D 21/14* (2013.01); *F25D 2303/081* (2013.01); *F25D 2331/801* (2013.01); *F25D 2331/803* (2013.01); *F25D 2331/805* (2013.01); *F25D 2331/809* (2013.01)

(58) Field of Classification Search

CPC ..... B65D 88/16; B65D 90/24; B65D 25/14; B65D 25/24; B65D 25/2864; B65D 25/38; B65D 25/22; F16N 31/004; F25D 3/08; F25D 21/14

USPC ..... 220/915.2, 915.1, 592.03, 592.26, 592.2, 220/571.1, 571, 630, 628, 739, 737, 904; 62/457.7, 457.5, 457.4, 457.3, 457.2, 62/457.1; 222/572, 569, 567, 608

See application file for complete search history.

(56) References Cited

U.S. PATENT DOCUMENTS

| | | | | |
|---|---|---|---|---|
| 10,173,827 | B1 | 1/2019 | Foote, Jr. | |
| 11,407,579 | B2 | 8/2022 | Munie et al. | |
| 2002/0096916 | A1 | 7/2002 | Combs | |
| 2004/0025530 | A1 | 2/2004 | Perrins | |
| 2004/0045980 | A1* | 3/2004 | Robins | A45F 3/16 222/63 |
| 2005/0082455 | A1 | 4/2005 | Jones | |
| 2008/0178629 | A1 | 7/2008 | Meether | |
| 2011/0240703 | A1 | 10/2011 | Hickmann et al. | |
| 2015/0001253 | A1* | 1/2015 | Slaton | A45F 3/20 222/144.5 |
| 2017/0055665 | A1* | 3/2017 | Lanzisera | A45C 11/20 |
| 2017/0079413 | A1* | 3/2017 | Guerrero | A45F 3/20 |
| 2017/0232355 | A1 | 8/2017 | Healy | |
| 2018/0199742 | A1 | 7/2018 | Rogers | |
| 2019/0077290 | A1 | 3/2019 | White et al. | |

OTHER PUBLICATIONS

U.S. Patent and Trademark Office, Non-Final Office Action dated Oct. 19, 2019, in U.S. Appl. No. 16/115,827, 21 pages total.

U.S. Patent and Trademark Office, Restriction Requirement dated Aug. 7, 2019, in U.S. Appl. No. 16/115,827, along with Election filed Oct. 2, 2019, 12 pages total.

Franklin, Missy, "Wine in a Purse? Boxed Wine Is Getting Classy," The Daily Meal, Sep. 5, 2012, 1 page.

Huted, Kristofor, "No More Shame: Boxed Wine Now Comes in a High-End Fashion Purse," NPR—The Salt, Sep. 3, 2012, 4 pages.

Lacsamanda, Pauline, "Drink on the Go With This Secret Luxury Wine Purse," Yahoo!Life—The Daily Meal, Feb. 14, 2017, 2 pages.

* cited by examiner

SYSTEM TO HOLD MULTIPLE BEVERAGE CONTAINERS

CROSS-REFERENCE TO RELATED APPLICATION

The present application is a continuation-in-part of U.S. patent application Ser. No. 16/943,057, filed on Jul. 30, 2020, which claims priority to U.S. patent application Ser. No. 16/115,871, filed Aug. 29, 2018, now U.S. Pat. No. 10,730,685, issued on Aug. 4, 2020, which claims priority to United States Provisional Patent Application No. 62/560,295, filed on Sep. 19, 2017, in the names of Russell W. White, Shawn A. Roberts, and Laura J. Roberts, entitled "System To Hold Multiple Beverage Containers," the content of which is hereby incorporated by reference.

FIELD OF THE DISCLOSURE

The present disclosure relates to beverage containers and, more specifically, to a system to hold multiple beverage containers.

BACKGROUND

Beverage containers come in many different sizes and shapes. Beverages may be served in bottles, in cans, in plastic cups, in glasses, and in insulated containers just to name a few. Many of these containers are designed to be hand-held, but there are circumstances that make holding multiple containers at once difficult or dangerous. Moreover, there are times when it is desirable to keep a collection of beverage containers cold or hot for extended periods of time. Aquatic and outdoor activities are frequently enjoyed in areas that do not lend themselves to the use of a refrigerator or an oven, and it is common for a person to want a cold or warm beverage while they are enjoying these types of activities. As such, individuals often need a cooler or other device capable of holding multiple containers and keeping those containers at or near a desired temperature.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
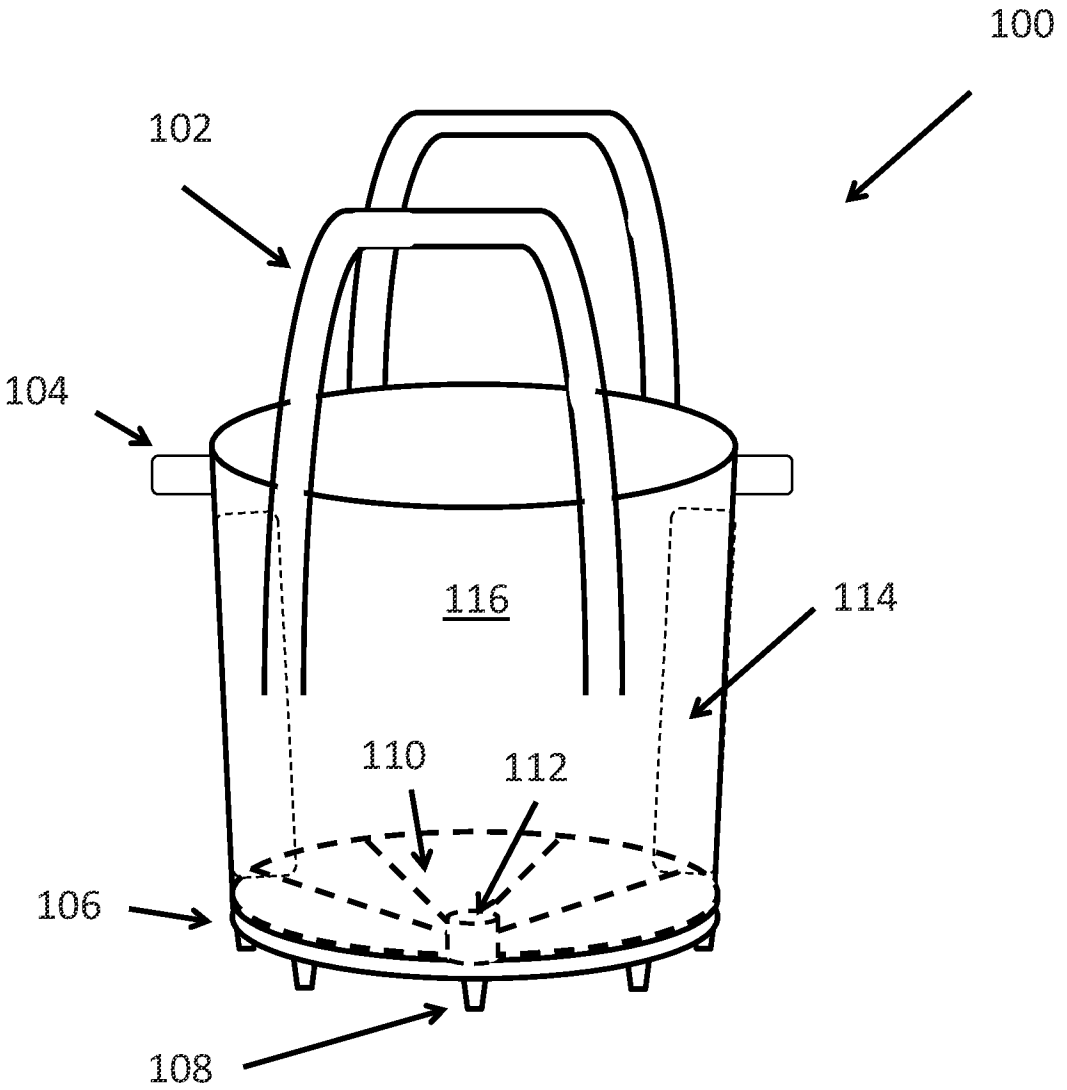
FIG. 1 depicts a general system for holding multiple beverage containers that incorporates teachings of the present disclosure.

The following discussion is intended to provide one skilled in the art with various teachings that can be combined and/or separated to create useful and/or desirable products. The teachings can be employed in a variety of settings. For example, a designer could use these teachings to create an automobile-oriented, boat-oriented, and/or other vehicle-oriented product. Additionally, a designer may want to employ many of these teachings to produce an attractive picnic or beach going type product.

While there are many opportunities for designers to use the teachings disclosed herein, the majority of this detailed description section will focus on embodiments designed for a soft-sided cooler that typically utilizes ice cubes or other frozen objects to facilitate keeping various beverage containers at a desired and chilled temperature. The decision to focus on this implementation is not intended to limit the scope of the teachings, but rather to facilitate a clear presentation of the teachings.

Devices that maintain multiple beverage containers at or near some desired temperature tend to be of two types: hard-sided insulated containers or soft-sided insulated containers. Hard-sided portable insulated containers tend to be made of molded plastic, with an inner layer, or wall, and an outer layer or wall, with an insulation space between. Hard-sided containers are rigid and frequently very heavy. They also tend to be bulky and difficult to carry. A soft-sided cooler, by contrast, can rely on external wall structure that is not substantially rigid. The wall structure may incorporate a multi-layer design that includes an outside layer of webbing or fabric, an inside layer of waterproof webbing or fabric, and a flexible insulation layer positioned between the inner and outer layers. A designer will recognize that layers may be added or removed to meet certain objectives. In some embodiments, a soft-sided cooler may include a rigid or semi-rigid element to give the cooler some stability and to help the cooler maintain a given shape or protect items inside the cooler.

Throughout this description, containers may be referred to as "coolers." Similarly, the portion of the container that opens and closes to facilitate accessing multiple beverage containers stored within the container will typically be referred to as the top of the container. As such, the base panel will typically be referred to as the bottom. The multiple layers that may make up the side walls may be a sandwich of various components. For example, a middle insulating layer may include a flexible or resilient layer of a relatively soft and flexible foam. As noted above, sidewall elements of the cooler may have insulating properties such that heat transfer across the panel is limited. An example of a potential panel construction is an internal core of foam such as closed cell polyurethane foam. The insulating foam is in turn received between a protective, potentially waterproof layer provided on the interior of the container and a potentially decorative layer of polymer sheeting, such as nylon sheeting. As explained in more detail below, a cooler incorporating teachings disclosed herein may include a convertible feature wherein a user can change an exterior panel of the cooler to give it a different look on different occasions or simply to replace a stained or dated exterior shell. In order to maintain the soft-sided characteristics of some embodiments, at least the sidewalls may be formed to be pliable.

To be clear, potential insulated coolers incorporating the teachings of this disclosure may be used to carry cold items such as soda, beer, sandwiches, ice cream, meat, and so on. Alternatively, the insulated coolers can be used to transport hot items such as casseroles, lasagna, vegetables, etc.

With that said and as mentioned above, FIG. 1 depicts a general system for holding multiple beverage containers that incorporates teachings of the present disclosure. Carrier 100 includes toting handles 102, closing tabs 104, and base 106. As depicted, base 106 may have a generally elliptical shape when viewed from above. In addition, base 106 may be formed from a molded plastic, rubber or synthetic rubber material. A designer may choose other materials to meet design objectives. As shown, base 106 includes feet 108, which may be formed as an integral part of base 106. For example, if base 106 is a molded part, feet 108 may be included in the mold. A more detailed description of what a base like base 106 may look like is included in connection with FIG. 4A.

As depicted in FIG. 1, base 106 includes a generally conic tapering drain floor 110 that makes up its top surface (as shown, feet 108 are on the bottom surface). Tapering drain floor 110 may facilitate the draining of carrier 100 by directing water (which may have resulted from melting ice) toward drain 112. As shown, drain 112 defines a hole that passes through the thickness of base 106 and allows water to escape an internal cavity of container 100 that is at least partially formed by sidewalls 116, which may be formed as a multi-layer wall where different layers perform different desired functions. For example, an inside layer closest to the internal cavity may be a waterproof layer, a middle layer may be an insulating layer, and an external layer may be a decorative layer.

As shown, beverage sleeves 114 are shown as being inside container 100. Depending on design concerns, beverage sleeves 114 may be formed from a stretch fabric, which may be a synthetic fabric that stretches. The stretch fabric may be a multi-way stretch fabric such as 2-way stretch or 4-way stretch. An exemplary 2-way stretch fabric may stretch in one direction, such as from selvedge to selvedge (but can be in other directions depending on the knit). An exemplary 4-way stretch fabric, such as spandex, may stretch in both directions, crosswise and lengthwise. A given stretch fabric may include fibers of neoprene. Example stretch fabrics could include elastomerics like spandex or Lycra. With that said, a designer could choose whichever stretch fabric he or she wanted to accomplish a given deign goal. A deeper understanding of the potential benefits of beverage sleeves 114 may be understood by referencing the next figure.

Figure 2:
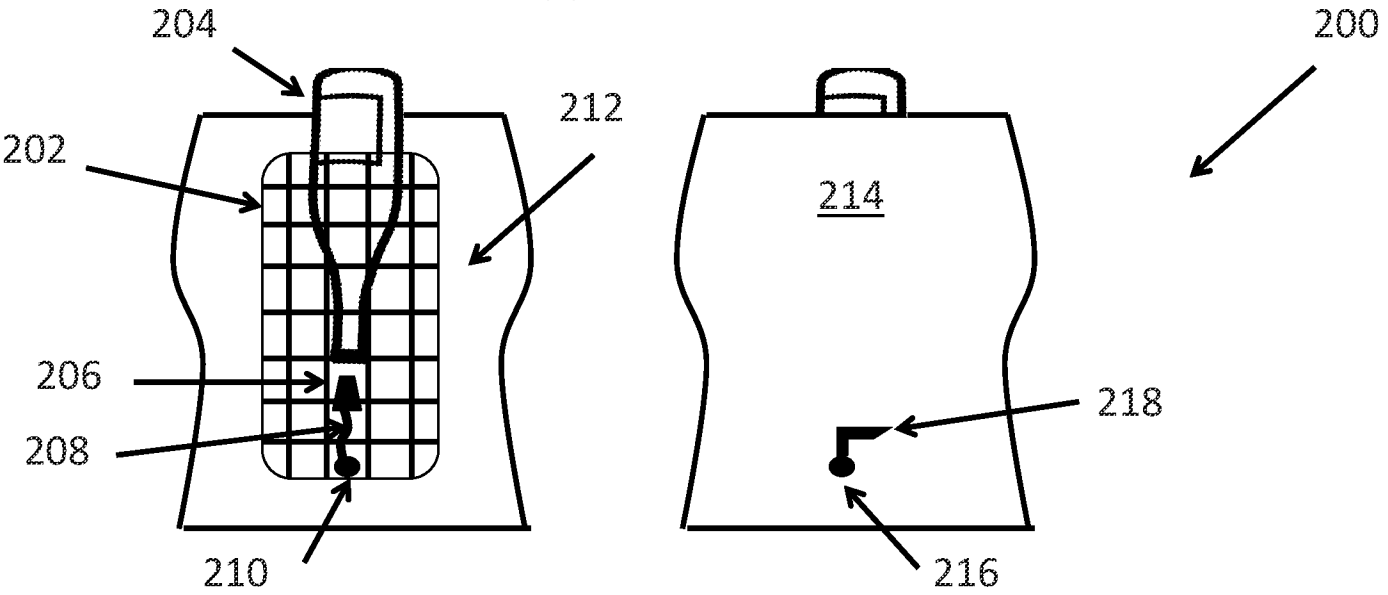
FIG. 2 illustrates an element of a given embodiment of a device for holding multiple beverage containers that incorporates teachings of the present disclosure.

As mentioned above, FIGS. 2 and 3 illustrate elements of a given embodiment of a device for holding multiple beverage containers that incorporates teachings of the present disclosure. As depicted, system 200 provides a beverage sleeve designed to maintain a bottled beverage 204 within a beverage sleeve 202. Sleeve 202 is depicted as having a grid pattern. A designer may choose any number of patterns. In some embodiments, sleeve 202 may not include holes larger enough for even small ice cubes to pass from one side to the other of sleeve 202. In such an embodiment, ice placed within a container like container 100 will not easily makes its way inside a sleeve like sleeve 202. This may make it easier for a user to remove and then replace bottled beverage 204 from sleeve 202.

As depicted, sleeve 202 is located inside and connected to inside wall surface 212. Also on the inside is plug 206 and tube 208. In practice, a user may remove the lid from bottled beverage 204 and insert plug 206 into the bottle's open end. The beverage inside may then be able to pass through the open end, through a hole within insert plug 206 and into tube 208, which is connected to plug 206. Tube 208 may be routed to and/or through port 210, which may allow the beverage inside the bottle to makes its way from the inside of a container to a dispensing port 216, which may located on or near an outside wall surface 214. Depending upon designer concerns, dispensing port 216 may be controlled by any number of devices. As shown, dispensing port 216 includes a lever-operated stopcock 218. One of skill in the art may choose other mechanisms such as a push button, etc. As shown, a container like container 100 that incorporates the elements of system 200 may allow a user to open a bottle of wine, connect the bottle to a dispensing mechanism (the one depicted uses gravity, but various pressuring mechanisms and/or other methods could be used), place the bottle inside the cooler, close the cooler, and enjoy the wine without having to reopen the cooler.

Figure 3:
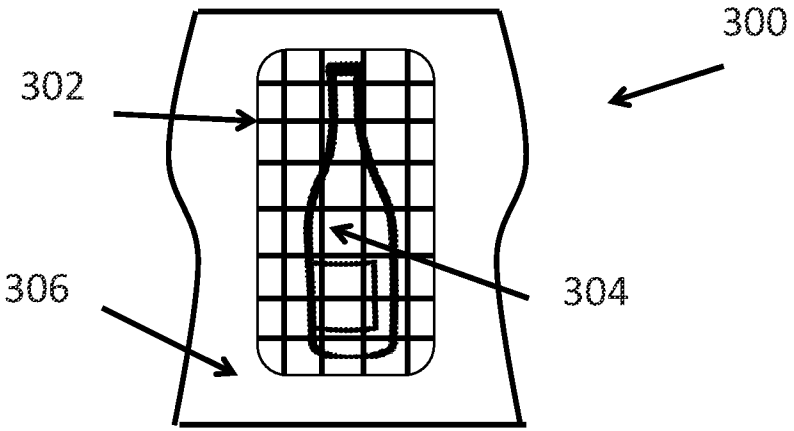
FIG. 3 illustrates an element of a given embodiment of a device for holding multiple beverage containers that incorporates teachings of the present disclosure.

FIG. 3 depicts a system 300 that removes the dispensing mechanism. Some users may prefer to simply place a bottle 304 within a sleeve 302 located along inside wall surface 306. Such an embodiment keeps bottle 304 cool and makes its easy to remove and replace bottle 304 within a container like container 100. As depicted in the first three figures, a container like container 100 may be proportioned such that a bottled beverage can be placed within a sleeve while still allowing the container to be closed. This helps keep the bottle upright while it is within the cooler. The sleeve also allows a user to benefit from the ice within a cooler as it keeps the bottle cool without having to "fight" the ice to fit the bottle back inside the cooler.

Figure 4A:
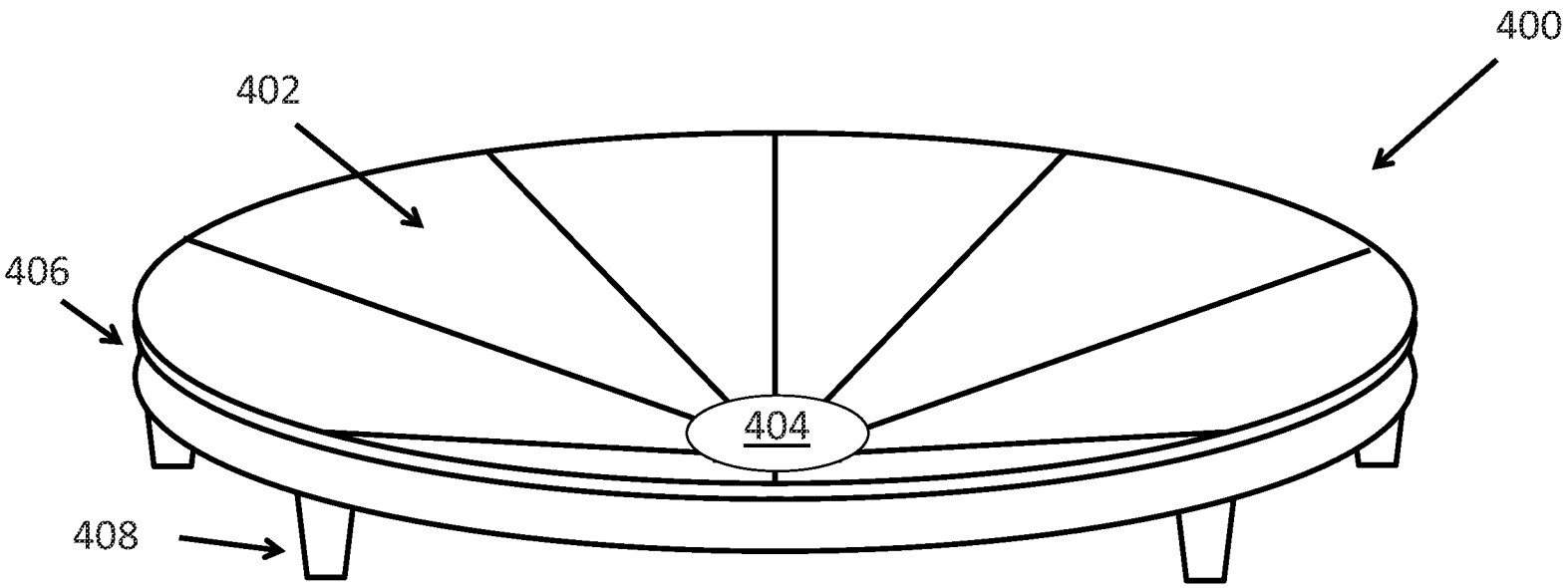
FIGS. 4A and 4B illustrate a base option for a given embodiment of a device for holding multiple beverage containers that incorporates teachings of the present disclosure.

As mentioned above, FIGS. 4A and 4B, and FIG. 5 illustrate base options for a given embodiment of a device for holding multiple beverage containers that incorporates teachings of the present disclosure. Base 400 is largely depicted as a single piece of material. A designer could utilize this technique or combine several different pieces to meet his or her objectives. As mentioned above, a designer could also choose from various materials to form base 400. It could be a rubber, a synthetic rubber, a plastic, a metal, a composite, and/or various other options. It could be injection molded, molded in other ways, 3D printed, formed, etc. As shown in FIG. 4A (a perspective view looking at the top of base 400), base 400 has a symmetrical draining geometry 402 directing water to a centrally located drain 404. A designed may also choose an asymmetrical geometry.

As shown, base 400 has a generally elliptical shape. In practice, the size, shape, and weight of base 400 may be chosen to facilitate a container's ability to maintain itself in an upright position. Base 400 is also depicted as having multiple feet 408 and a couple ridge 406. In practice, base 400 may be formed of a material that is different that the multi-layer sidewalls of a cooler utilizing base 400. Moreover, base 400 may be formed in separately and in a different location. It may be brought together with the sidewalls during a manufacturing process. As such, ridge 406 may facilitate a mating of base 400 with a sidewall of a designer's choosing.

Figure 4B:
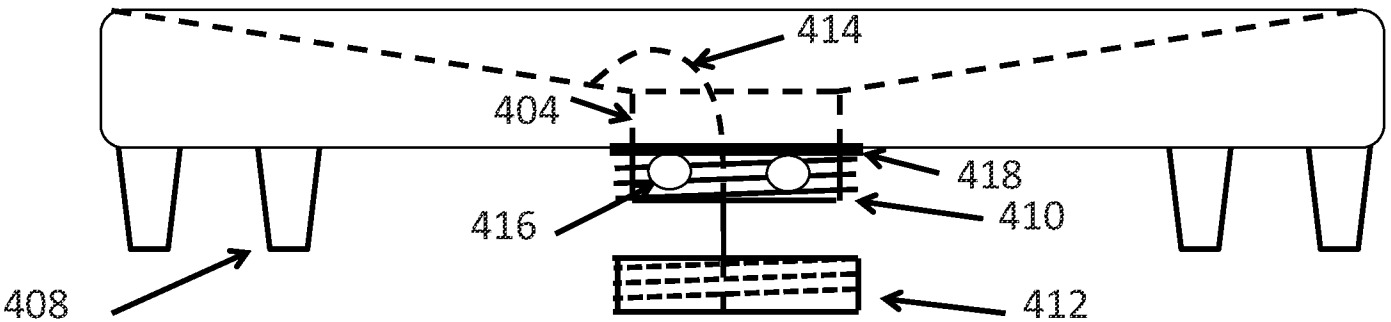
Figure 5:
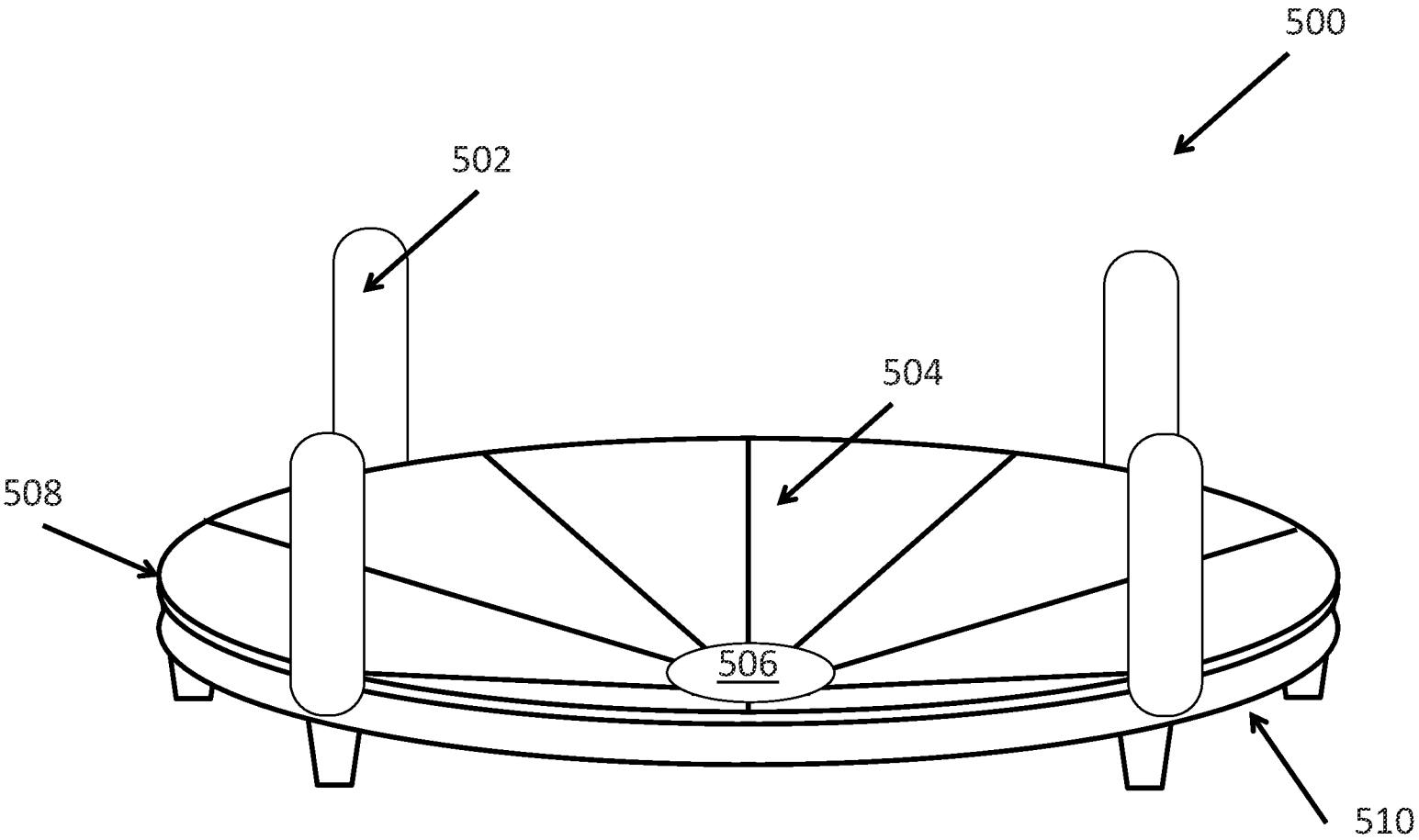
FIG. 5 illustrates a base option for a given embodiment of a device for holding multiple beverage containers that incorporates teachings of the present disclosure.

FIG. 4B presents a side view of base 400, which indicates a thickness to the body of the base. As shown in this embodiment, feet 408 are sufficient long to allow the body of base 400 to be elevated from a surface upon which feet 408 rest. Drain 404 extends through base 400 and an extended portion of drain 404 includes a threaded surface 410. As shown, the male threads of threaded surface 410 are designed to interact with the threaded surface located within cap 412, which is tethered to base 400 via securing tether 414. A designer may choose any number of techniques (or no technique at all) to ensure that cap 412 is not easily lost. The tethering option depicted is just one option. As shown, threaded surface 410 includes drain ports 416. In some embodiments, a designer may design the system in a manner that allows a user to unscrew cap 412 without allowing for cap's 412 complete disconnection from base 400. In such an embodiment, ports 416 may allow water to escape from within the cooler without risking the loss of cap 412. As shown, ring 418 is included. Ring 418 may be, for example, a rubber O-ring that helps ensure a waterproof seal when cap 412 is secured to base 400 via threaded surface 410.

As mentioned above, FIG. 5 illustrates a base option, base 500, for a given embodiment of a device for holding multiple beverage containers that incorporates teachings of the present disclosure. As shown, base 500 includes four stiffening tabs 502. In practice, tabs 502 may assist in keeping a soft-sided cooler in an upright position by acting in a skeleton like manner. Providing some vertical structure, tabs 502 may help keep a cooler from tipping over. Base 500 also includes a draining geometry 504. As shown, geometry 504 may create a generally symmetrical and conical void directed toward drain 506. As mentioned above, drain 506 may be located nearer a given edge in some designs as opposed to in the center. Similarly, a base may take on a square, rectangular, triangular, elliptical, circular, etc. shape. Base 500 also includes an interior material coupling ridge 508 and an exterior material coupling ridge 510. As mentioned above, soft-sided sidewalls may be formed with a multi-layer offering. An interior facing material may be a waterproof material. A middle layer may be an insulating material. In some embodiments, a third layer may be used to encapsulate the insulating layer between the interior layer and the third layer. A designer may want such a three layer "bag" to be coupled to the base along coupling ridge 508, which could also be located closer to drain 506. The methodology for connecting the "bag" to the base could take several forms. It could be a near permanent connection or an easily removed connection. It could include adhesives, heat treatments, zipping solutions, etc.

In such a system, the designer may want to offer users an interchangeable exterior layer that could be, for example, more decorative. In such a system, the designer may want the exterior layer to couple to the base at ridge 510. For example, an exterior layer may utilize a zipper to connect to base 500. The exterior could also use other connection techniques. For example, the exterior layer may include straps that connect underneath base 500. However connected, an interchangeable exterior layer may allow users a great deal of flexibility in changing the appearance and/or replacing an existing worn or tattered exterior shell. As shown, tabs 502 may be located between an interior multi-layer "bag" and an exterior layer.

Figure 6:
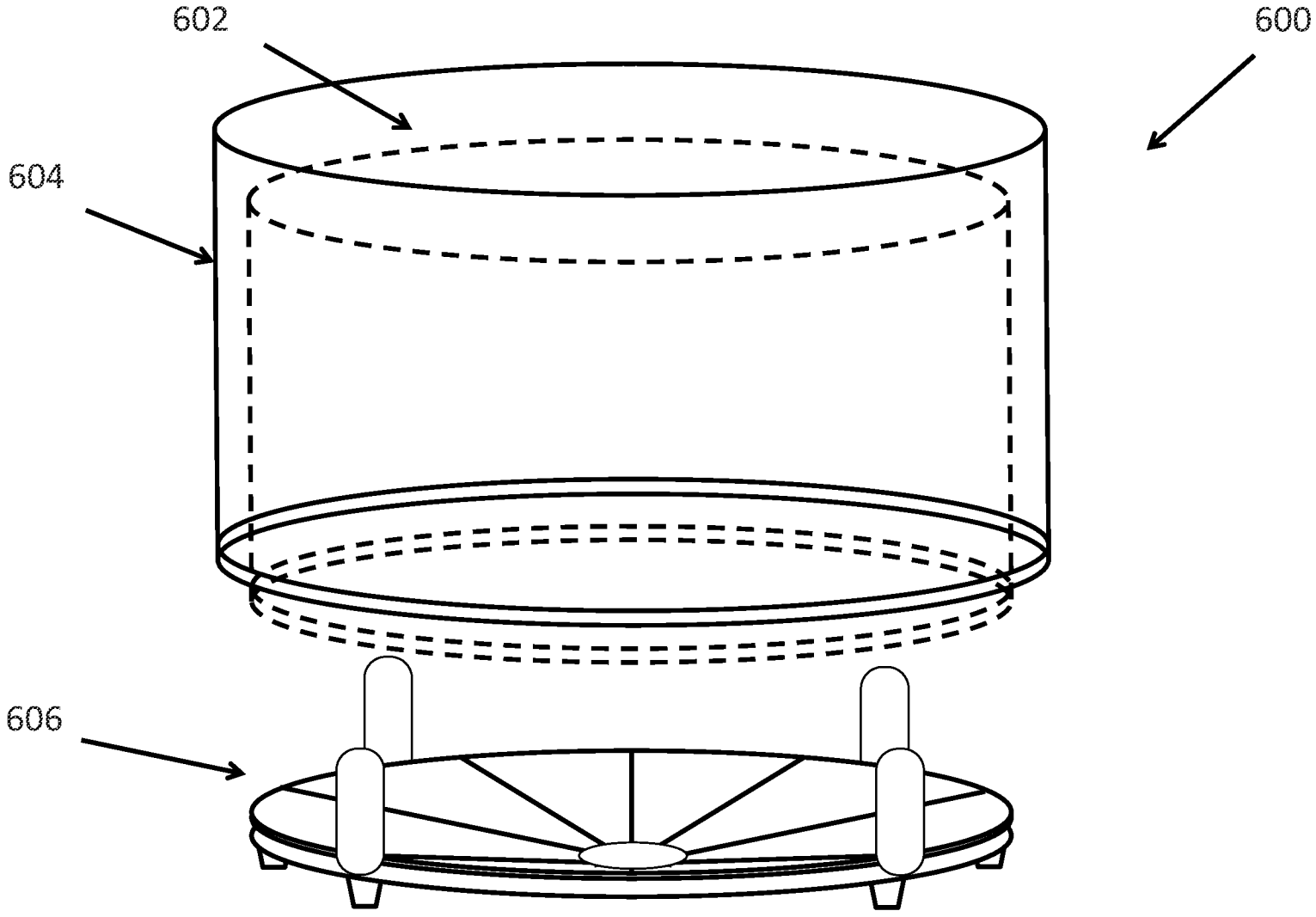
FIG. 6 illustrates an exploded view for a given embodiment of a device for holding multiple beverage containers that incorporates teachings of the present disclosure.

FIG. 6 illustrates an exploded view for a given embodiment of a device for holding multiple beverage containers that incorporates teachings of the present disclosure. System 600 an interior material or multi-layer material 602, and exterior material 604, and a base 606. In practice the three pieces may be manufactured separately from one another and then assembled into a complete system 600.

Figures 7A, 7B, 7C:
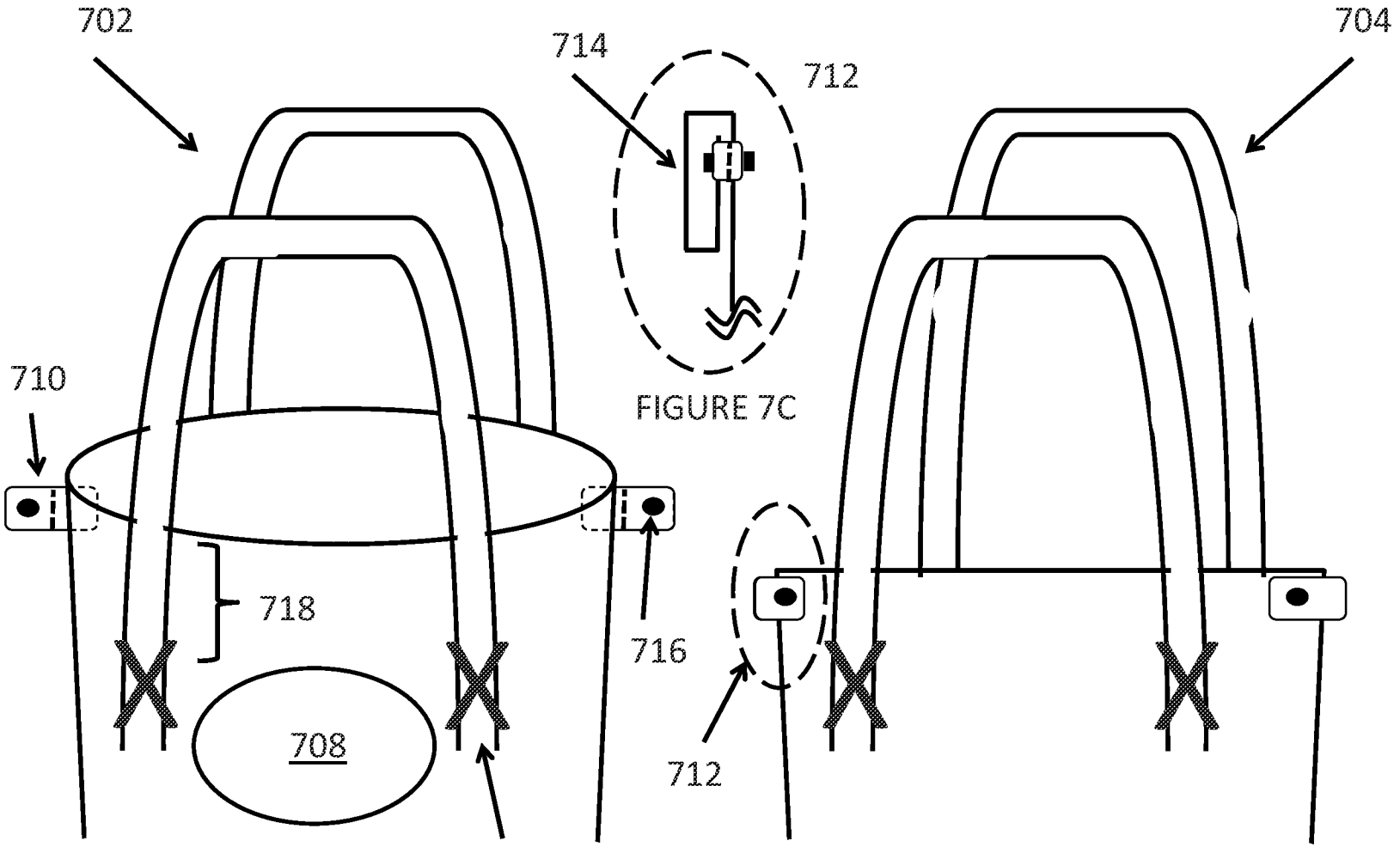
FIGS. 7A-7C illustrate open and closed views for a given embodiment of a device for holding multiple beverage containers that incorporates teachings of the present disclosure.

FIGS. 7A-7C illustrate open and closed views, respectively, for a given embodiment of a device for holding multiple beverage containers that incorporates teachings of the present disclosure. As shown, carrier 702 is an open configuration allowing easy access to the interior void of the carrier. Carrier 704 presents a closed configuration of the container. As shown on carrier 702, handles are connected to an exterior surface using stitching 706. The location of stitching 706 relative to the top of opened container 702 may be chosen to leave sufficient distance 718 to allow a rolled or folded closing of carrier 702. Carrier 702 also includes a branding or monogramming surface 708 and magnetic tab closers 710.

As shown with carrier 702, magnetic tabs 710 are in an open position. The tabs are in a closed position 712 in connection with carrier 704 and FIG. 7C. As shown more clearly in FIG. 7C, container sidewall 714 is folded over itself twice and magnetic tabs 710 are in a closed position. In use, magnet 716 is attracted to another magnet on the other end of tab 710. When the top of the container is folded over itself, magnetic tab 710 may be folded in half to bring magnet 716 into close proximity with the magnet on the other end of tab 710. In the folded or closed position, the two magnets hold tab 710 closed and assist in insulating the interior portion of the container.

Figure 8:
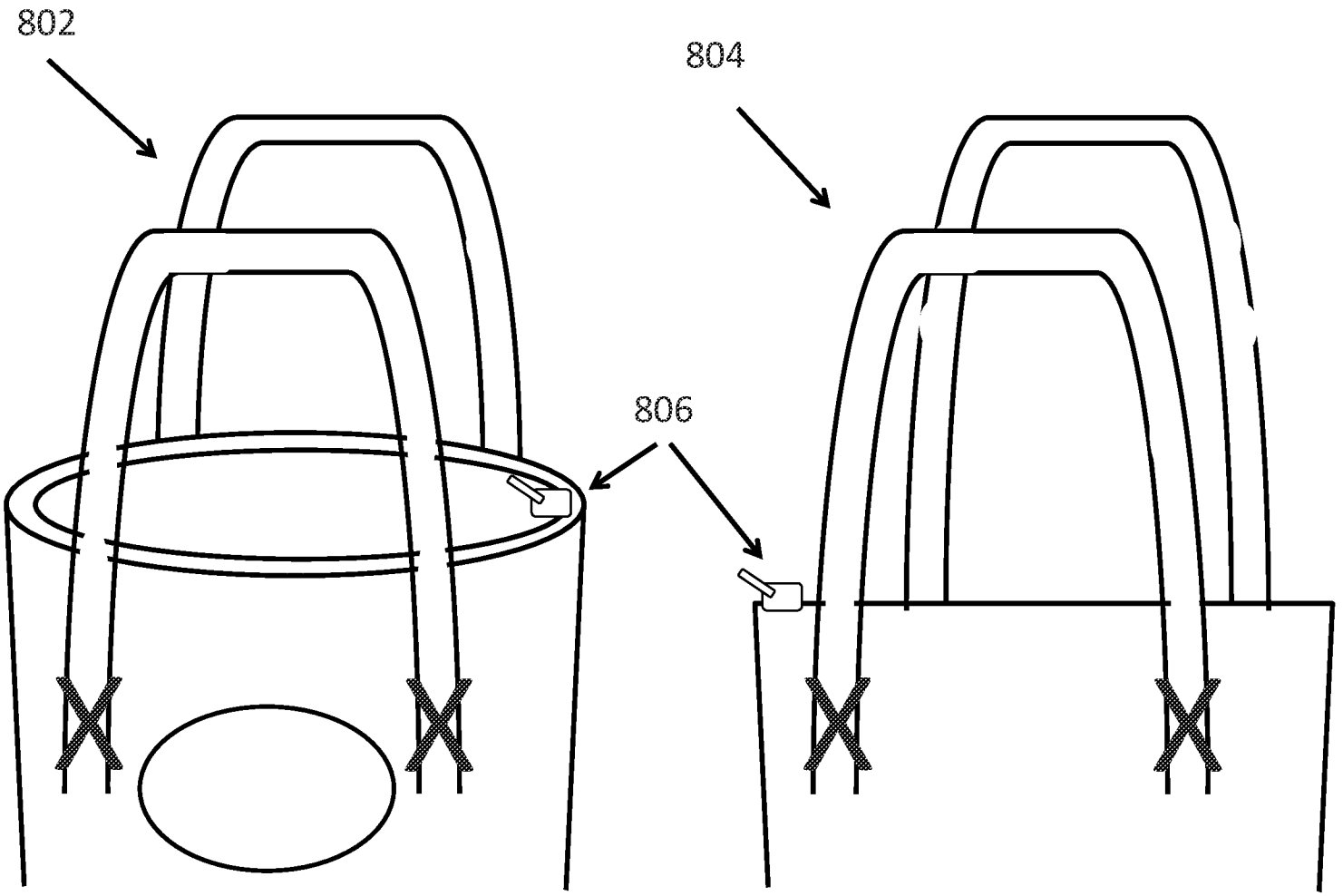
FIG. 8 illustrates an open and closed view for a given embodiment of a device for holding multiple beverage containers that incorporates teachings of the present disclosure.

FIG. 8 illustrates an open 802 and closed 804 view for a given embodiment of a device for holding multiple beverage containers that incorporates teachings of the present disclosure. In the embodiment of FIG. 8, the opening and closing mechanism is a zipper 806 or zip-lock type of locking mechanisms. A designer may choose whatever type of closing mechanism works for his or her design.

Figure 9A:
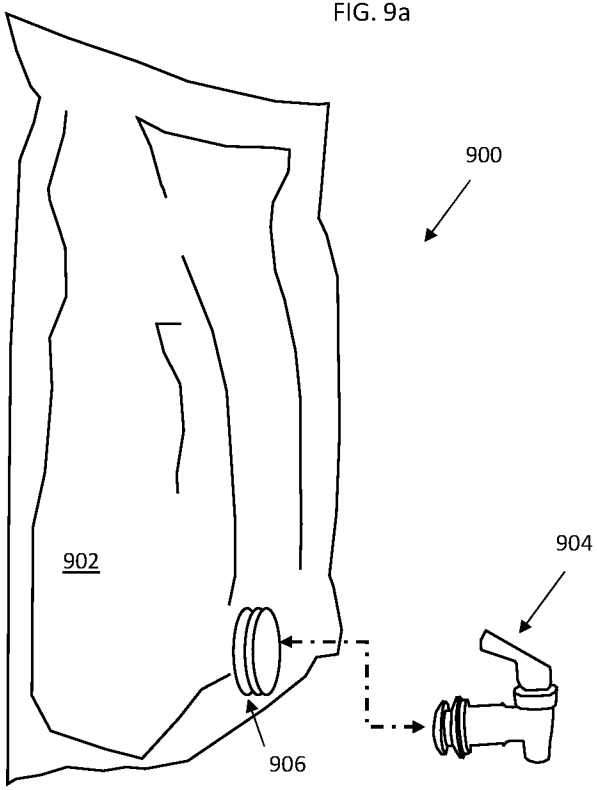
FIG. 9*a* illustrates a refillable beverage container incorporating teachings of the present disclosure.
Figure 9B:
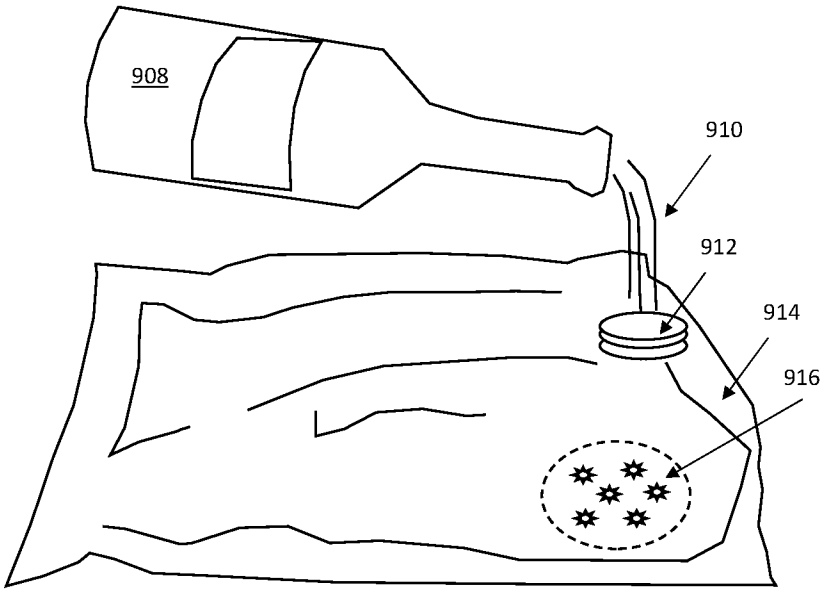
FIG. 9*b* illustrates a process for filling a bag incorporating teachings of the present disclosure.

As mentioned above, FIG. 9 illustrates a system 900 that includes a bag 902 that may be filled with a liquid. In practice, the bag may be sized to hold 750 ml (a typical bottle of wine), 1500 ml (two typical bottles of wine), and/or some other amount chosen by a designer. Bag 902 may be refillable. For example, bag 902 might have a removeable dispensing mechanism 904. A user may remove mechanism 904 from attachment location 906 and pour a liquid inside bag 902. At some point, the user may empty bag 902, clean bag 902, and refill bag 902 with a similar or different liquid. Though bag 902 is depicted as having a removable dispensing mechanism 904, a designer may elect to have a dispensing mechanism that is not removeable. In such a system or even in a system with removable dispensing mechanism, a designer may want a top portion of the bag to be capable of being opened and resealed like a zip-to-lock closing mechanism. Other methodologies for opening a bag to allow the addition of a liquid and then resealing the bag could also be employed without departing from the spirit of the teachings disclosed herein.

As mentioned above, FIG. 9*b* illustrates the act of filling a bag in a manner that incorporates teachings of the present disclosure. As shown, a bottle 908 is pouring a liquid 910 through a hole 912 to fill bag 914. As depicted bag 914 has a dehydrated drink mix 916 located within it. In practice, drink mix 916 may be placed within bag 914. The drink mix 916 may interact with the liquid 910 to form a preferred beverage.

Ingredients that may be included with drink mix 916 could be, for example, one or more of granulated honey, citric acid, malic acid, lemon oil, lemon juice, sugar, lime oil, lime juice, ascorbic acid, dried cane syrup, crystalized lime, crystalized lemon, cranberry powder, tomato powder, worcestershire sauce powder, distilled vinegar, molasses powder, spices, tamarind, sulfiting agents, maltodextrin, silicon dioxide, celery salt, sea salt, celery seed, cayenne pepper, orange powder, bitters powder, tangerine juice, almond flavor powder, crystalized grapefruit, grapefruit oil, grapefruit juice, licorice powder, etc.

Figure 10:
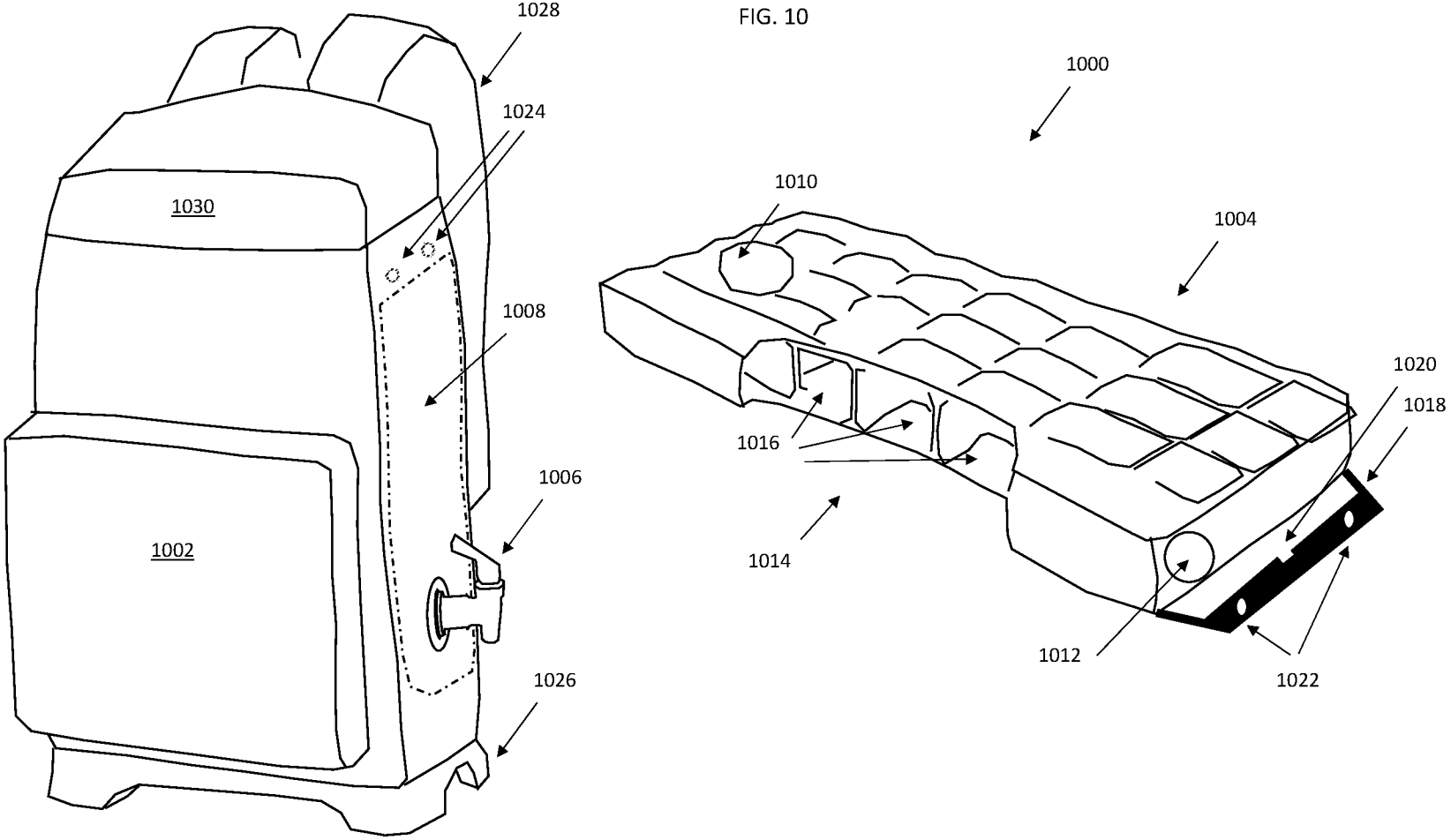
FIG. 10 illustrates a soft-sided backpack style cooler and refillable container system incorporating teachings of the present disclosure.

In some cases, dried combinations of these and other ingredients could allow a designer to offer a cocktail bag option. For example, a designer could offer a margarita bag that includes a drink mix including sugar, citric acid, lime oil, lime juice, ascorbic acid, and dried cane syrup. In practice, a user could add water and tequila to the bag (perhaps one part water and two parts tequila), replace a removable dispensing mechanism, shake, and ultimately mount the bag inside a cooler sleeve as described more fully in FIGS. 10 and 11.

Cocktail options could include margaritas, cosmos, bloody mary's, old fashioneds, mai tais, daiquiris, palomas, bee's knees, etc. And, liquids to be added could include water, gin, tequila, rum, whiskey, bourbon, vodka, etc. A user may not necessarily want an alcoholic cocktail. As such, non-alcoholic cocktails could be used. Similarly, red wines, white wines, roses, sparkling wines, orange juice, water, etc. could be placed in a bag like bag 914. In some cases, a designer may choose to provide a backpack cooler with a collection of different drink bags. A user may be able to join a club and request different drink mixes on some periodic schedule.

As mentioned above, FIG. 10 illustrates a system 1000 that includes a soft-sided backpack style cooler 1002 and a refillable container system 1004 incorporating teachings of the present disclosure. As depicted, backpack cooler 1002 is a soft-sided cooler with a drink dispenser 1006 and a drink sleeve 1008. As shown drink sleeve 1008 is located inside cooler 1002. At least a portion of sleeve 1008 may be made from a stretch fabric. For example, a bottom portion may be capable of stretching enough to allow a bag with a dispenser attached (like bag 902) to be easily placed with sleeve 1008 in a manner that allows a dispenser to extend outside the cooler at least far enough to allow a user to access and operate the dispenser without re-opening the cooler.

As shown, the refillable container 1004 has two potential locations for adding a liquid, openings 1010 and 1012. Container 1004 is also depicted with a cutaway view 1014 to reveal an internal, multi-chamber structure. In practice chambers 1016 may be interconnected and open to one another in a manner to allow liquid to flow between them. The structures may also be attached to both a top and bottom surface of container 1004 in a manner that helps container 1004 maintain a generally rectangular cuboid shape. Of course, a designer may choose other shapes and/or techniques to facilitate a container's ability to maintain a shape as liquid is added and/or removed from the container. For example, a user may use a rigid or semi-rigid material. Regarding materials, a designer may elect a flexible foil material, a rigid plastic material, a flexible plastic material, a leather material, a rubber material, a metal material, a composite material, etc.

In some cases, a designer might choose a rectangular cuboid shape with approximate dimensions of 9 inches by 10 inches by 1 inch. Some designers might also choose dimensions like 8½ inches by 10 inches by 1¼ inches. A designer might choose dimensions like these based upon a desired volumetric capacity such as around 1500 ml. As such, a designer might also choose dimensions like 7 inches by 5 inches by 1⅓ inches in an effort to provide a user with a 750 ml capacity.

Referring back to FIG. 10, container 1004 may include a hanger 1018 with a hanging notch 1020 and/or hanging holes 1022. In practice, hanger 1018 may facilitate a proper location within sleeve 1008. As shown, protrusions 1024 are located within cooler 1002. In the depicted system, protrusions 1024 are sized and located in a manner to allow for an interference fit within holes 1022. In practice a user may fill container 1004 with a desired liquid, slide container 1004 within sleeve 1008, and removably secure container 1004 in place by pressing holes 1022 onto protrusions 1024.

Other techniques of location container 1004 may be utilized. For example, notch 1020 may allow for hanging container 1004 from a hook or other mechanism located with cooler 1002. In another embodiment, a designer could make use of a hook and loop type attachment mechanism for attaching container 1004 in place.

Figure 11:
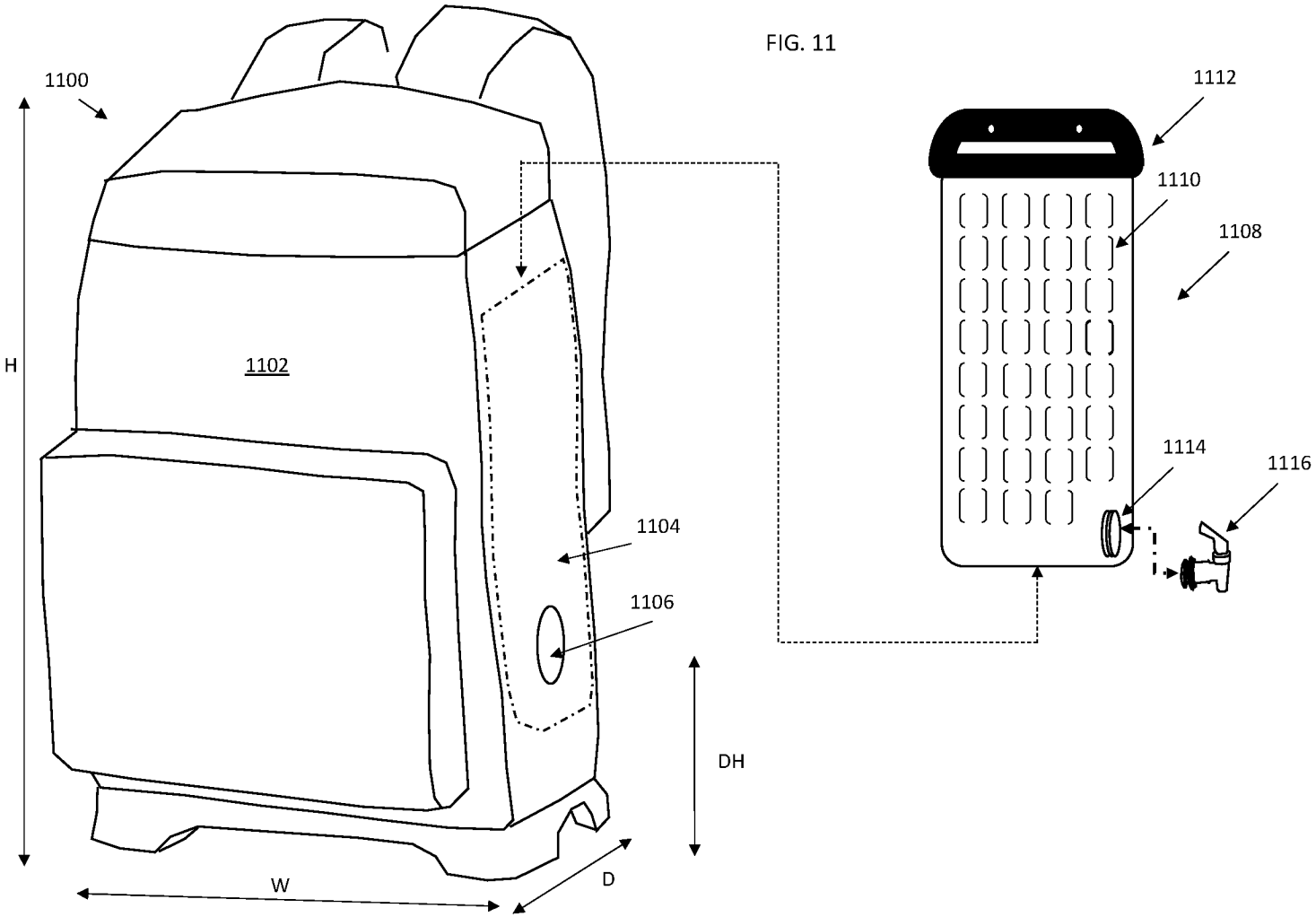
FIG. 11 illustrates a soft-sided backpack style cooler and refillable container system incorporating teachings of the present disclosure.

As shown, cooler 1002 has a base 1026 that includes feet. Cooler 1002 also includes toting straps 1028 and a hinge type lid 1030 for accessing an interior portion of cooler 1002. As mentioned above, FIG. 11 illustrates a similar system 1100 that includes a soft-sided backpack style cooler 1102 with an internal beverage sleeve 1104 and a hole 1106 formed to allow a drink dispensing mechanism to be extend from within the cooler to a location accessible to a user outside the cooler. System 1100 also includes a refillable container system 1108 incorporating teachings of the present disclosure. Container system 1108 has a multi-chambered internal structure as indicated by a tufted appearance on its external surface 1110. Container system 1108 also includes a hanger 1112, an attachment location and mechanism 1114, and a dispensing system 1116. In practice, location and mechanism 1114 allows for a snap and seal connection with dispensing system 1116 that allows dispensing system 1116 to be removed and replaced in a manner that maintains a water tight or near water tight connect when connected. In some system, a designer may not want to rely upon this type of sealing solution. In some cases, a dispensing system may be non-removably sealed in place using radio frequency welding. For example, a designer may choose to use a PVC material, a polyurethane material, etc., for the bag and dispensing system and then "weld" the two together using radio frequency welding to create a water-tight seal. In such a system, the designer may allow the top of a container to be opened and closed using a zip-to-lock type closing mechanism or some other appropriate closure that facilitates adding a liquid to a container and then sealing the liquid within the container. As shown in FIG. 11, a filled container system 1008 may be placed within cooler 1102 and inside sleeve 1104 in a manner that allows dispensing system 1016 to extend through 1106.

Depending upon design concerns, a designer might choose to form hole 1106 approximately 7-10 inches above a surface the cooler is resting on. In such a system, a user might find it easier to place a glass or cup under dispensing system 1016. As such, DH might be 7-10 inches. Similarly, H might be over 20 inches, W might be over 16 inches, and D might be over 9 inches. Other sizes could also be used. For example, H, W, and D could be adjusted to accommodate a given container size a designer wants to use recognizing that a backpack cooler might include an insulation layer that is ½ inch thick or thinner to 1½ inches thick or thicker. As such, if a designer wants to create a 1500 ml container with a dispensing port that is 8 inches off the ground, the designer may choose to create a backpack cooler with an internal height dimension of over 18 inches, an internal depth dimension of over 9 inches, and an internal width dimension of 16 inches. Assuming a 1 inch insulation layer and a 2 inch tall base, the designer may produce a backpack cooler with an H of over 20 inches, a W of over 18 inches, and a D of over 11 inches. The overall size and appearance may depend on designer preferences.

The benefits, advantages, solutions to problems, and any element(s) that may cause any benefit, advantage, or solution to occur or become more pronounced are not to be construed as a critical, required, or essential feature or element of the present invention. Accordingly, the present invention is not intended to be limited to the specific form set forth herein, but on the contrary, it is intended to cover such alternatives, modifications, and equivalents, as can be reasonably included within the spirit and scope of the invention as provided by the claims below.

While the present invention has been described with respect to a limited number of embodiments, those skilled in the art will appreciate numerous modifications and variations therefrom. It is intended that the appended claims should cover any such modifications and variations as fall within their true spirit and scope.

What is claimed is:

1. A beverage carrying tote, comprising:

a base;

a sidewall coupled to the base, wherein the sidewall comprises a pliant material;

a beverage sleeve located within an enclosure at least partially formed by the sidewall, the beverage sleeve configured to at least partially form a pocket configured to hold a beverage container;

a port hole formed through the sidewall;

a dispensing system with a flow control mechanism, wherein at least a portion of the dispensing system is configured to extend through the port hole when the dispensing system is coupled to an installed beverage container that is located within the beverage sleeve;

the flow control mechanism operable to stop the flow of a beverage when the flow control mechanism is in a closed position and to allow the flow of the beverage when the flow control mechanism is in an opened position; and a toting strap.

2. The beverage carrying tote of claim 1, wherein the installed beverage container is a bag.

3. The beverage carrying tote of claim 1, wherein the sidewall and the toting strap are formed into a backpack cooler.

4. The beverage carrying tote of claim 1, wherein the flow control mechanism comprises a push button to facilitate transitioning from the closed position to the opened position.

5. The beverage carrying tote of claim 1, further comprising the installed beverage container.

6. The beverage carrying tote of claim 5, wherein the installed beverage container comprises a multi-chambered internal structure.

7. The beverage carrying tote of claim 1, wherein the beverage carrying tote is a backpack cooler having an external height dimension of over twenty inches, an external depth dimension of over nine inches, and an external width dimension of at least sixteen inches.

8. A system to hold a beverage, comprising:

a beverage container configured to be secured within a cooler, the beverage container having an exterior surface and an interior structure that includes a plurality of interconnected chambers;

a resealable opening of the beverage container that facilitates adding a liquid into the interior structure;

a dispensing system for the beverage container located near a bottom of the beverage container, wherein the dispensing system has a flow control mechanism, wherein at least a portion of the dispensing system is configured to extend through a port hole of the cooler when the beverage container is installed within the cooler; and a hanger for the beverage container located near a top of the beverage container and configured to facilitate maintaining a suspended position within the cooler when the beverage container is installed within the cooler.

9. The system of claim 8, further comprising a drink mix located within the beverage container.

10. The system of claim 8, further comprising the cooler, wherein the cooler includes a beverage sleeve located within an enclosure at least partially formed by a cooler sidewall, the beverage sleeve including a 4-way stretch fabric section to facilitate loading and unloading the beverage container within the beverage sleeve.

11. The system of claim 8, wherein the resealable opening is resealed by placing a plug of the dispensing system into a hole.

12. The system of claim 8, wherein the resealable opening includes a zip-to-lock sealing mechanism.

13. The system of claim 12, wherein the zip-to-lock sealing mechanism is located near a top of the beverage container.

14. The system of claim 8, wherein at least a portion of the beverage container is formed from a radio frequency weldable material.

15. A system to carry things, comprising:

a backpack cooler having a base and a sidewall;

a beverage sleeve located within an enclosure at least partially formed by the sidewall, the beverage sleeve configured to at least partially form a pocket configured to hold a beverage container;

a port hole formed through the sidewall, wherein the port hole and the beverage sleeve are configured such that a dispensing system of the beverage container will at least partially extend through the port hole when the beverage container is located within the beverage sleeve;

an external height dimension of the backpack cooler that is at least twenty inches;

an external width dimension of the backpack cooler that is at least sixteen inches; and an external width dimension of the backpack cooler that is at least nine inches.

16. The system of claim 15, wherein the backpack cooler has a hinging top for gaining access to an interior portion of the backpack cooler.

17. The system of claim 15, further comprising the beverage container, wherein the dispensing system of the beverage container is located near a bottom of the beverage container, further wherein the dispensing system has a flow control mechanism that includes a push button mechanism and the push button mechanism is included in a portion of the dispensing system that at least partially extends through the port hole when the beverage container is located within the beverage sleeve.

18. The system of claim 17, wherein the beverage container has an internal volume greater than 750 milliliters.

19. The system of claim 17, wherein the beverage container has an internal volume greater than 1500 milliliters.

20. The system of claim 17, wherein the beverage container has an exterior surface and an interior structure that includes a plurality of interconnected chambers.

* * * * *